US006179570B1

(12) United States Patent
Smith

(10) Patent No.: US 6,179,570 B1
(45) Date of Patent: Jan. 30, 2001

(54) VARIABLE PUMP CONTROL FOR HYDRAULIC FAN DRIVE

(75) Inventor: David P. Smith, Joliet, IL (US)

(73) Assignee: Caterpillar Inc., Peoria, IL (US)

( * ) Notice: Under 35 U.S.C. 154(b), the term of this patent shall be extended for 0 days.

(21) Appl. No.: 09/328,127

(22) Filed: Jun. 8, 1999

(51) Int. Cl.[7] ..... F04B 49/00; F04B 9/08; F16D 31/02

(52) U.S. Cl. ..... 417/212; 417/390; 60/445

(58) Field of Search ..... 417/212, 222.1, 417/390; 60/443, 445

(56) References Cited

U.S. PATENT DOCUMENTS 4,152,896 * 5/1979 Tohma et al. ..... 60/445
4,408,453 * 10/1983 Westveer ..... 60/445
4,420,937 * 12/1983 Naruse et al. ..... 60/450
4,487,255 * 12/1984 Bianchetta et al. ..... 417/213
4,738,330 * 4/1988 Suzuki et al. ..... 60/443
5,165,377 11/1992 Hosseini ..... 123/41.12
5,561,978 10/1996 Buschur ..... 60/424
5,800,130 * 9/1998 Blass et al. ..... 417/213
5,876,184 * 3/1999 Marcott ..... 417/213
5,876,185 * 3/1999 Schimpf et al. ..... 417/213
5,907,952 * 6/1999 Akasaka et al. ..... 60/445

* cited by examiner

*Primary Examiner*—Timothy S. Thorpe
*Assistant Examiner*—Michael K. Gray
(74) *Attorney, Agent, or Firm*—J. W. Burrows

(57) ABSTRACT

A variable pump control for a hydraulic fan drive is provided to control the speed of the fan between a maximum and a minimum desired value. A proportional solenoid valve arrangement is provided to established a maximum displacement of a variable displacement pump which drive a fluid motor having a cooling fan attached thereto. A variable electrical signal is directed to the proportional solenoid valve arrangement to proportionally reduce the displacement of the pump thus reducing the speed of the cooling fan to a predetermined minimum desired level.

13 Claims, 2 Drawing Sheets

VARIABLE PUMP CONTROL FOR HYDRAULIC FAN DRIVE

TECHNICAL FIELD

This invention relates generally to the control of the speed of a cooling fan and more particularly to a variable pump control to selectively control the speed of a hydraulic fan drive.

BACKGROUND ART

Hydraulic fan drive systems are well known in the art to drive cooling fans. In one such arrangement two different fluid motors are used in combination to provide the needed torque at higher speed. At lower speeds only one of the fluid motors is used. In other arrangements, activation of and the speed of the cooling fan is controlled in response to the temperature of the working fluid in the system. In many fan drive systems, a variable displacement pump is used to drive the fluid motor and the speed of the fluid motor is controlled by varying the displacement of the variable displacement pump. In these systems, the pump control signal is directed through a variable orifice and then subsequently through a fixed orifice to the tank or through a fixed orifice first and then through a variable orifice. The variable orifice may be controlled by a spool valve that is movable in response to a remote signal, either manual or electrical. The metering of the control signal to tank produces undesirable heat and also many times requires larger pumps since there is a constant amount of flow being passed to the tank. Additionally, using small orifices to reduce the flow loss results in an orifice that is sensitive to plugging from debris in the fluid. Likewise, when using this type of control, it may also be necessary to provide a closed logic for the fan speed. Typically, U.S. Pat. No. 5,876,185 issued Mar. 2, 1999 to Schimpf et al. teaches an arrangement that modulates the control pressure to the pump control for control of pump displacement in a given direction and bleeds off fluid flow only to change pump displacement in the opposite direction. A variable force is provided to the control spool in opposition to the spring control force in order to provide the modulated control pressure to the pump control. Additionally, the discharge pressure of the pump is applied against a differential area of the control spool in order to provide a force against the spring control force that is directly related to the discharge pressure. The control pressure to the pump control generally decreases as the discharge pressure increases but is not linear. This can cause pump control instability that requires spool dampening orifices to be added. Otherwise the control instability reduces the fan drive component life. Since the maximum pump pressure is controlled solely by the one spool and if dampening is added then the maximum pressure can overshoot again resulting in pump and motor component life reduction as well as possible life reduction in valves and components.

Accordingly, the present invention is directed to overcoming one or more of the problems as set forth above.

DISCLOSURE OF THE INVENTION

In one aspect of the present invention, a pump control arrangement is provided for controlling the displacement of a variable displacement pump that receives fluid from a reservoir. The variable displacement pump has a pressure outlet port and a displacement changing actuator that is operative to change the displacement of the variable displacement pump between a minimum and a maximum position. The pump control arrangement is adapted for use in a fan drive system having a fluid motor that is fluidity connected to the variable displacement pump. The pump control arrangement includes a proportional solenoid valve arrangement connected to the pressure outlet port of the variable displacement pump and operative to control the flow of pressurized fluid to and from the displacement changing actuator. The proportional solenoid valve arrangement includes a spring biasing mechanism, a proportional valve, and a proportional solenoid, the proportional valve having first and second ends with the spring biasing mechanism disposed at the first end and a pressure chamber defined at the second end and being connected downstream of the proportional valve, the spring biasing mechanism being operative to bias the proportional valve to a position to pass flow from the variable displacement pump therethrough, and the proportional solenoid is disposed at the second end of the proportional valve and operative to provide a variable force in opposition to the spring bias acting at the first end.

BEST MODE FOR CARRYING OUT THE INVENTION

Figure 1:
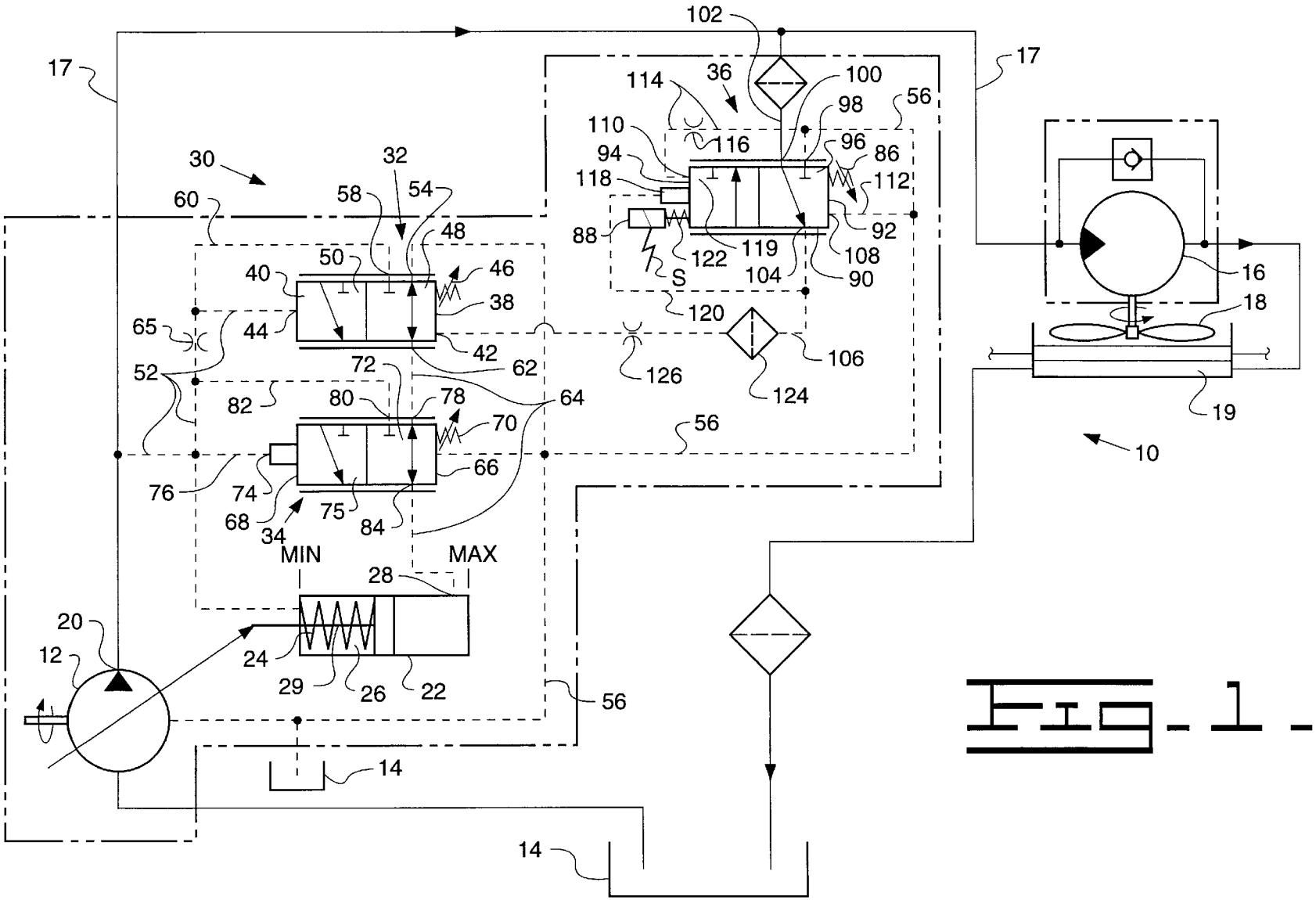
FIG. 1 is a partial schematic and a partial diagrammatic representation of a pump control arrangement for use in a fan drive system incorporating an embodiment of the subject invention.

Referring to FIG. 1, a fan drive system 10 is illustrated. The fan drive system 10 includes a variable displacement pump 12 that receives fluid from a reservoir 14 and a fluid motor 16 that is fluidity connected to the pump 12 via a supply conduit 17. The fluid motor 16 drives a cooling fan 18 that is operative to provide cooling air through a heat exchanger/radiator 19. It is recognized that the heat exchanger/radiator 19 could have various fluids being directed therethrough for cooling; such as water, hydraulic oil, transmission oil, air conditioning fluid, etc.

The pump 12 has a pressure outlet port 20 of which the supply conduit 17 is connected. The displacement of the pump 12 is controlled by a displacement changing actuator 22. The displacement changing actuator 22 is movable between minimum and maximum displacement positions. In the subject embodiment of FIG. 1 the displacement changing actuator 22 is biased by a spring 24 disposed in a spring chamber 26 to the maximum displacement position and movable against the spring bias towards the minimum position in response to a pressure signal directed thereto through an inlet port 28. The spring chamber 26 of the displacement changing mechanism 22 has an actuating rod 29 extending therethrough and the spring chamber 26 is connected to the pressure outlet port of the pump 12. It is recognized that in some variable displacement pumps the connection of the spring chamber 26 to the pressure outlet port 20 of the pump 12 is not needed.

A pump control arrangement 30 is provided to control the displacement of the pump 12 between its minimum and maximum positions. The pump control arrangement 30 of the subject embodiment includes a load margin valve arrangement 32, a pressure cutoff valve 34 and a proportional solenoid valve arrangement 36. The load margin valve arrangement 32 has first and second ends 38,40 each respectively defining a pressure responsive chamber 42,44. A spring 46 is disposed at the first end thereof and operative to bias the load margin valve arrangement 32 to a first position 48. The load margin valve arrangement 32 is movable towards a second position 50 in response to pressurized fluid from the pressure outlet port 20 of the pump 12 being directed to the second pressure responsive chamber 44 by a conduit 52 and a portion of the supply conduit 17. The load margin valve arrangement 32 is a three-way valve and has a first port 54 connected to the reservoir 14 by a conduit 56, a second port 58 connected to the pressure outlet port 20 of the pump 12 by a conduit 60 and portions of the conduits 52,17 and a third port 62 connected to the inlet port 28 of the displacement changing actuator 22 by a conduit 64. A damping orifice 65 may be disposed in the conduit 52 upstream of the second port 58 and the second pressure responsive chamber 44 of the load margin valve arrangement 32.

The pressure cutoff valve 34 may be disposed in the conduit 64 and has first and second ends 66,68 with a spring 70 disposed at the first end 66 and the spring 70 is operative to bias the pressure cutoff valve 34 to a first position 72. A pressure chamber 74, which can be in the form of a differential area on the valving element or a biasing piston acting on the valving element, is disposed at the second end 68 thereof and is operative to move the pressure cutoff valve 34 to a second position 75 in response to receipt of pressurized fluid from the pressure outlet port 20 of the pump 12 by a conduit 76 and portions of the conduits 52,17. The pressure cutoff valve 34 is a three-way valve and has a first port 78 connected to the third port 62 of the load margin valve arrangement 32 by a portion of the conduit 64, a second port 80 connected to the pressure outlet port 20 of the pump 12 by a conduit 82 and portions of the conduits 52,17 and a third port 84 connected to the inlet port 28 of the displacement changing actuator 22 by another portion of the conduit 64.

The proportional solenoid valve arrangement 36 includes a spring biasing mechanism 86, a proportional solenoid 88, and a proportional valve 90. The proportional valve 90 is a three-way valve having a valving element therein (not shown) and first and second ends 92,94. The spring biasing mechanism 86 is disposed at the first end 92 and operative to bias the proportional valve 90 (valving element) towards a first position 96. The proportional valve 90 also has a first port 98 connected to the reservoir 14 by the conduit 56, a second port 100 connected to the pressure outlet port 20 of the pump 12 by a conduit 102 and a portion of the conduit 17, and a third port 104 connected to the pressure chamber 42 in the first end 38 of the load margin valve arrangement 32 by a conduit 106.

The first and second ends 92,94 of the proportional valve 90 has respective fluid vent chambers 108,110 connected to the reservoir 14 by respective conduits 112,114 and the conduit 56. A control orifice 116 is disposed in the conduit 114. A pressure chamber 118 which is formed by a differential area or a biasing piston is defined in the second end 94 of the proportional valve 90 and connected to the third port 104 by a conduit 120. The effective cross-sectional area of the pressure chamber 118 is less than the cross-sectional area of the valving element in the proportional valve 90.

The proportional solenoid 88 is disposed at the second end of the proportional valve 90 and operative to apply a varying force in opposition to the spring biasing mechanism 86 in response to receipt of a variable electrical signal "S" to move the proportional valve 90 towards a second position 119. A captured spring assembly 122 is disposed at the second end 94 between the proportional solenoid 88 and the housing of the proportional valve 90. The captured spring assembly 122 has a predetermined spring load applied thereto.

A filter mechanism 124 is provided in the conduit 106 between the third port 104 of the proportional valve 90 and the pressure chamber 42 at the first end 38 of the load margin valve 32. An orifice 126 is also disposed in the conduit 106 between the filter mechanism 124 and the pressure chamber 42.

Figure 2:
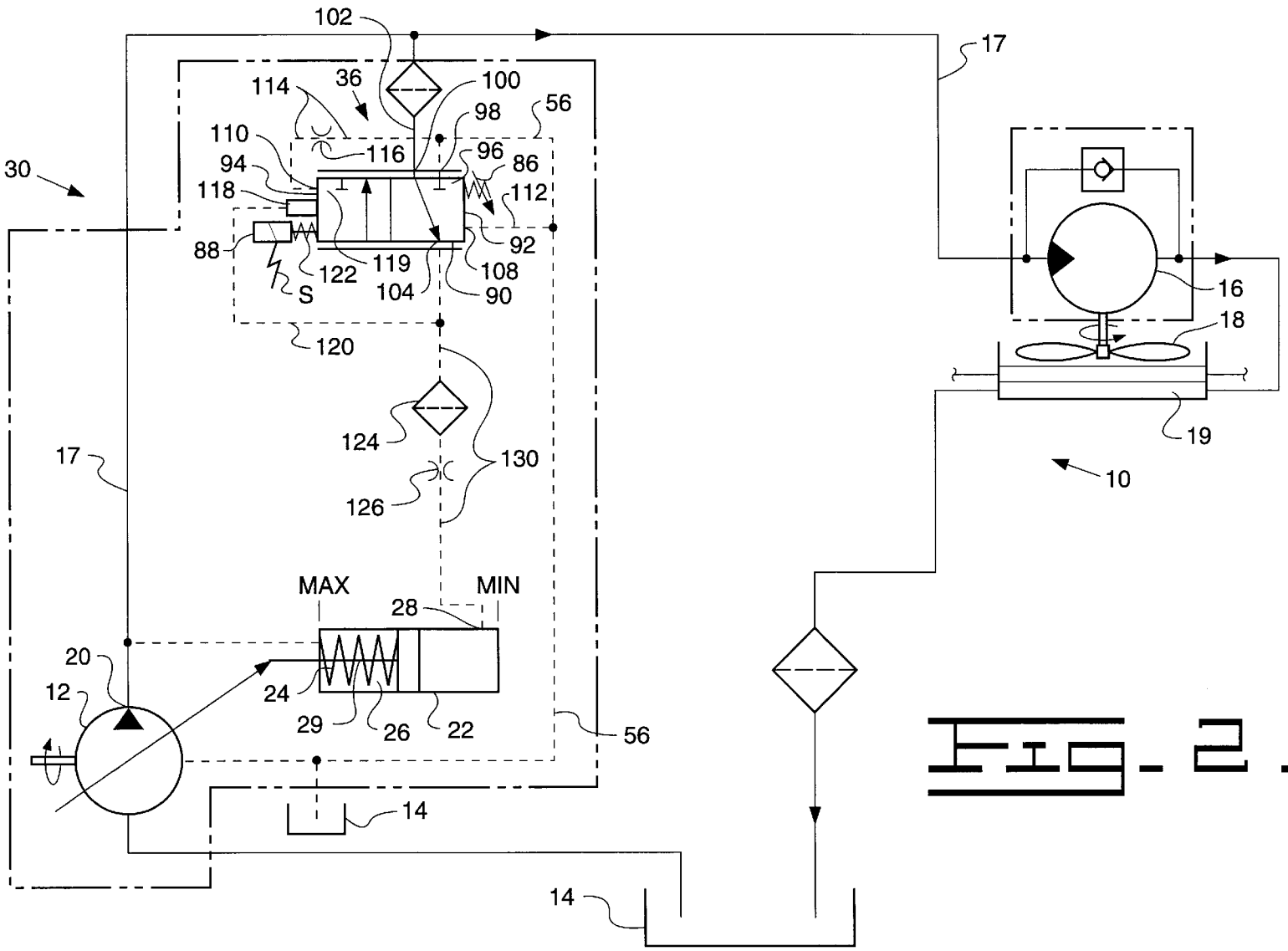
FIG. 2 is a partial schematic and a partial diagrammatic representation of a pump control arrangement for use in a fan drive system incorporating another embodiment of the subject invention.

Referring to FIG. 2, another embodiment of the subject invention is illustrated. Like elements have like element numbers. In the embodiment of FIG. 2, the spring 24 biases the displacement changing actuator 22 towards its minimum displacement position as opposed to the maximum displacement position illustrated in FIG. 1. In the subject embodiment, the pressurized fluid from the pump 12 can also aid in urging the displacement changing actuator 22 towards the minimum displacement position but is not usually needed. The displacement changing actuator 22 is urged towards its minimum displacement position by the inherent swivel forces that are present within the pump 12 and towards its maximum displacement by a pressure signal received at the inlet port 28 thereof. The load margin valve arrangement 32 and the pressure cutoff valve 34 of FIG. 1 are not needed in the subject embodiment. The functions of the load margin valve arrangement 32 and the pressure cutoff valve 34 are automatically incorporated in the proportional solenoid valve arrangement 36.

The proportional solenoid valve arrangement 36 is the same as that of FIG. 1. The second port 100 is connected to the pressure outlet port 20 of the pump 12 by the conduits 102,17. The only difference is that the third port 104 is connected to the inlet port 28 of the displacement changing actuator 22 by a conduit 130 and the filter mechanism 124 and the orifice 126 are respectively disposed in the conduit 130 between the third port 104 of the proportional valve 90 and the inlet port 28 of the displacement changing actuator 22.

It is recognized that various alternatives could be utilized without departing from the essence of the subject invention. It is recognized that by changing the effective cross-sectional area of the pressure chamber 118 with respect to the effective cross-sectional area of the valving element within the proportional valve 90, speed range and/or torque ranges of the fluid motor 16 can be changed. It is also recognized that the proportional solenoid valve arrangement 36 could be a separate cartridge assembly located adjacent to or remote from the pump 12.

INDUSTRIAL APPLICABILITY

The operation of the fan drive system 10 of the embodiment illustrated in FIG. 1 is described hereafter. When operation of the pump 12 is initiated with no electrical signal "S" being delivered to the proportional solenoid 88, pressurized fluid is directed to the fluid motor 16 to turn the cooling fan 18. The initial flow of fluid from the pump 12 to the fluid motor 16 starts the fluid motor 16 turning. The resistance torque created by the cooling fan 18 moving air thereacross creates pressure in the supply conduit 17. At initial startup of the pump 12, the spring 24 has the displacement changing actuator 22 biased to the maximum displacement position. Since the spring biasing mechanism 86 has the proportional valve 90 in its first position, the pressure in the supply conduit 17 is directed across the proportional valve 90 to the pressure chamber 42 at the first end of the load margin valve arrangement 32. The force from the pressure in the pressure chamber 42 acts in cooperation with the force of the spring 46 to maintain the load margin valve arrangement 32 in its first position. Even though the pressure in the conduit 17 is also available to the pressure chamber 44 in the second end of the load margin valve arrangement 32, the pressure is not sufficient to move the load margin valve arrangement 32 to its second position against the combined force of the spring 46 and the pressure of the fluid in the pressure chamber 42. Consequently, the pump 12 continues to be biased towards its maximum displacement position.

As the speed of the cooling fan 18 increases, the pressure in the supply conduit 17 increases due to the increasing resistance to the movement of more air across the cooling fan 18. The pressure of the fluid in the conduit 17 and the pressure chamber 42 of the load margin valve arrangement 32 is also present through conduit 120 in the pressure chamber 118 at the second end of the proportional valve 90. Once the pressure of the fluid in the pressure chamber 118 reaches a level to overcome the force of the spring biasing mechanism 86 at the first end thereof, the proportional valve 90 begins to move towards its second position 119. As the proportional valve 90 moves towards its second position, the pressure of the fluid in the conduits 106,120 is controlled at a predetermined level that is a function of the force of the spring biasing mechanism 86. Additional increases of the pressure in conduit 17 causes the proportional valve 90 to move to a position to maintain the pressure in the conduits 106,120 at a predetermined level. Since the pressure in the conduit 17 is being directed to the second end 40 of the load margin valve arrangement 32, further increases of pressure in the conduit 17 starts to urge the load margin valve arrangement 32 towards its second position 50 against the bias of the pressure in the conduit 106 and the bias of the spring 46. As the load margin valve arrangement 32 is moving towards its second position 50, the pressurized fluid from the conduit 17 at the second port 58 is directed to the third port 62 and on to the inlet port 28 of the displacement changing actuator 22. As the pressure in the displacement changing actuator 22 increases, the displacement of the pump 12 is urged towards its minimum displacement position. However, if the displacement of the pump 12 decreases, there is a resulting decrease in the speed of the cooling fan 18 and consequently, a decrease in the pressure in the conduit 17. A reduction of the pressure in the conduit 17 reduces the pressure in the pressure chamber 44 thus allowing the load margin valve to move back towards its first position 48. The load margin valve arrangement reaches a position at which the displacement changing actuator 22 is maintained in a maximum desired displacement position. With the pump 12 being maintained at its maximum desired displacement, the speed of the cooling fan 18 is maintained at its maximum desired speed level.

In order to lower the speed of the cooling fan 18, an electrical signal "S" is directed to the proportional solenoid 88. The proportional solenoid 88 produces a force that is proportional to the electrical signal "S". The force is directed against the proportional valve 90 in opposition to the biasing force of the spring biasing mechanism 86. The additional force from the proportional solenoid 88 in combination with the force from the pressurized fluid in the conduits 106,120 urges the proportional valve 90 towards its second position 119. Movement of the proportional valve 90 towards its second position 119 throttles the fluid from the conduit 17 to the conduit 106 and throttles a portion of the fluid from the conduit 106 to the reservoir 14. A reduction of the pressure in the conduit 106 reduces the pressure level of the fluid in the pressure chamber 42 of the load margin valve arrangement 32. Consequently, the load margin valve arrangement 32 is urged towards its second position 50. As the load margin valve arrangement 32 is moved towards its second position 50, pressurized fluid from the pump 12 is directed to the displacement changing actuator 22 urging it towards the minimum displacement position. A reduction of fluid flow from the pump 12 to the fluid motor 16 causes a proportional reduction in the speed of the fluid motor 16.

By increasing the magnitude of the electrical signal "S", the speed of the fluid motor 16 is proportionally reduced in the manner set forth above. Once the displacement changing actuator 22 has reduced the displacement of the pump 12 to its minimum desired displacement position, the speed of the fluid motor 16 is at its lowest desired speed level. The electrical signal "S" may be controlled in various ways. For example, a lever may be controlled manually by an operator so that the operator can selectively control the speed of the cooling fan 18 or the electrical signal may be automatically generated in response to predetermined system parameters such as the temperature of various fluids being directed through the heat exchanger/radiator 19. The speed of the cooling fan 18 may also be decreased in response to startup or shutdown of the work machine. Other alternatives may be utilized without departing from the essence of the subject invention.

In the event there is a sudden increase or spike in system pressure, the pressure cutoff valve 34 quickly responds to direct pressurized fluid into the displacement changing actuator 22 to lower the speed of the cooling fan 18. Once the sudden increase or spike is reduced or stabilized, the pressure cutoff valve 34 returns to its first position 72 thus allowing normal operation of the fan drive system 10.

The control orifice 116 functions to control the rate of movement of the valving element in the proportional valve 90. Since it is well known that valving elements leak, the fluid vent chambers 108,110 are provided to drain the leakage to the reservoir 14. When the proportional valve 90 is in its second position 119, it is desirable to control the rate at which it moves back to its first position 96. By controlling the rate of movement of the proportional valve 90 from its second position 119 to its first position 96, the stability of the proportional valve 90 is greatly enhanced.

The captured spring assembly 122 acts to control the maximum force being generated by the proportional solenoid 88. Since the captured spring assembly 122 has a predetermined preload and the captured spring assembly 122 is disposed between the proportional solenoid 88 and the housing of the proportional valve 90, the degree of movement of the proportional valve 90 is controlled. Once the proportional solenoid 88 engages the captured spring assembly 122, further movement is inhibited by the captured spring assembly 122. This acts to provide a consistent, repeatable maximum force from the proportional solenoid 88 to the proportional valve 90 and therefore a consistent desired low speed condition of the cooling fan 18.

The damping orifice 65 functions to control the rate at which the pressurized fluid from the pump 12 is delivered to the respective second port 58 and the second pressure responsive chamber 44. This acts to provide stability to the load margin valve arrangement 32 and to the displacement changing actuator 22.

The filter mechanism 124 functions to collect any foreign particles from reaching and plugging the orifice 126. The orifice 126 functions to control the rate of fluid being directed to the first pressure responsive chamber 42 of the load margin valve arrangement 32 thus enhancing its stability.

Referring to the operation of FIG. 2, upon startup of the pump 12, it is at its minimum displacement position since the spring 24 has biased the displacement changing actuator 22 to the minimum displacement position. As the flow from the pump 12 is directed to the fluid motor 16, the fluid motor 16 begins to rotate the cooling fan 18. The turning resistance created by the movement of air across the cooling fan 18 results in an increased pressure of the fluid in the conduit 17. With the proportional valve 90 spring biased to its first position 96, pressurized fluid from the conduit 17 is directed thereacross to the displacement changing actuator 22 at inlet port 28 thus urging it towards the maximum displacement position. As the pressure of the fluid within the pump 12 increases the inherent swivel forces within the pump 12 increases. The swivel forces act to urge the displacement of the pump 12 towards the minimum displacement position. Consequently, with the increase of the pressure in the conduit 17 created by the resistance of the cooling fan 18 turning being directed to port 28, the pump 12 continues to increase in displacement. Likewise, the speed of the cooling fan 18 continues to increase. Since the pressure of the fluid in the conduit 130 from the conduit 17 is also acting in the pressure responsive chamber 118 of the proportional valve 90, once the force created by the pressure equals and exceeds the force of the spring biasing mechanism 86, the proportional valve 90 moves towards its second position 119. As the proportional valve 90 moves towards its second position 119, the pressurized fluid from the conduit 17 is throttled thereacross and the pressurized fluid within the conduits 130,120 is throttled to the reservoir 14. Therefore, movement of the displacement changing actuator 22 is stopped at a displacement position that is its maximum desired displacement position. If the swivel forces within the pump 12 attempt to further decrease the pressure in the conduit 17, the decrease in pressure is sensed through the conduits 130,120 to move the proportional valve 90 further back towards its first position 96 thus throttling more pressurized fluid from the conduit 17 to displacement changing actuator 22 urging the displacement and discharge pressure to be maintained. Consequently, a maximum desired displacement of the pump 12 is maintained and therefor a maximum desired speed of the cooling fan 18 is maintained. In the event there is a sudden increase or spike in system pressure, the swivel forces tend to decrease pump displacement which limit the magnitude of the pressure spike.

In order to lower the speed of the cooling fan 18, an electrical signal "S" is directed to the proportional solenoid 88. The force created therefrom acts on the proportional valve 90, as set forth above with respect to FIG. 1, to move the proportional valve 90 towards its second position 119. As the proportional valve 90 moves towards its second position 119, the displacement changing actuator 22 moves towards the minimum desired displacement position since the pressure of the fluid in the conduit 130 is being reduced. As the displacement of the pump 12 decreases, there is a corresponding decrease in the speed of the cooling fan 18. Once the displacement changing actuator 22 reaches its minimum desired displacement position, the speed of the cooling fan 18 is at its minimum desired speed level.

The electrical signal "S" can be controlled in many ways as set forth above with respect to the operation of FIG. 1. Likewise, the control orifice 116 functions in the same manner as that set forth in the operation of FIG. 1 to stabilize the movement of the proportional valve 90. The filter mechanism 124 and the orifice 126 in the conduit 130 act to provide stability to the movement of the displacement changing actuator 22. The pump minimum and maximum displacement positions can be set below and above the predetermined minimum and maximum desired displacement positions by the controls allowing larger tolerance in internal pump displacement stops.

In view of the foregoing, it is readily apparent that a pump control arrangement 30 is provided to control the speed of a fan drive system 10 that is simple in construction, does not require use of a closed logic, does not continually bleed control fluid to the reservoir and uses a modulated pump discharge pressure as a control pressure instead of actual discharge pressure.

Other aspects, objects and advantages of the present invention can be obtained from a study of the drawings, the disclosure and the appended claims.

What is claimed is:

1. A pump control arrangement for controlling the displacement of a variable displacement pump that receives fluid from a reservoir, the variable displacement pump having a pressure outlet port and a displacement changing actuator operative to change the displacement of the variable displacement pump between a minimum and a maximum position, the pump control arrangement being adapted for use in a fan drive system having a fluid motor fluidity connected to the variable displacement pump, the pump control arrangement comprising:

a proportional solenoid valve arrangement connected to the pressure outlet port of the variable displacement pump and operative to control the flow of pressurized fluid to and from the displacement changing actuator, the proportional solenoid valve arrangement includes a spring biasing mechanism, a proportional valve, a captured spring having a predetermined pre-load and a proportional solenoid, the proportional valve being a three-way valve having first and second ends with the spring biasing mechanism disposed at the first end and a pressure chamber defined at the second end with the pressure chamber being connected downstream of the proportional valve, the three-way valve having a first port connected to the reservoir, a second port connected to the pressure outlet port of the variable displacement pump, and a third port connected to one of a load margin valve and the displacement changing actuator, the proportional valve being movable between first and second positions and at the first position thereof the one of the load margin valve arrangement and the displacement changing actuator is in communication with the pressure outlet port of the variable displacement pump and blocked from the reservoir and at the second position thereof the one of the load margin valve and the displacement changing actuator is in communication with the reservoir and blocked from the pressure outlet port of the variable displacement pump, the captured spring being disposed between the proportional solenoid and the proportional valve, the spring biasing mechanism being operative to bias the three-way proportional valve to a position to pass fluid from the variable displacement pump therethrough, and the proportional solenoid is disposed at the second end of the three-way proportional valve and operative to provide a variable force in opposition to the spring bias acting at the first end.

2. The pump control arrangement of claim 1 including a fluid vent chamber disposed respectively at the first and second ends of the proportional valve and each being connected to the reservoir and an orifice disposed between the fluid vent chamber at the second end of the proportional valve and the reservoir.

3. The pump control arrangement of claim 1 wherein the displacement of the variable displacement pump is movable towards a minimum displacement position in response to internal swivel force and the bias of a spring mechanism and movable towards a maximum displacement position in response to pressurized fluid being delivered to the displacement changing actuator from the proportional solenoid valve arrangement.

4. The pump control arrangement of claim 1 wherein the load margin valve arrangement is disposed between the pressure outlet port of the variable displacement pump and the displacement changing actuator, the load margin valve arrangement having first and second ends each defining pressure responsive chambers with the first end being spring biased to a position to pass fluid from the variable displacement pump therethrough and the second end thereof being connected to the pressure outlet port of the variable displacement pump.

5. The pump control arrangement of claim 4 wherein the load margin valve arrangement is a three-way valve having a first port connected to the reservoir, a second port connected to the pressure outlet port of the variable displacement pump, and a third port connected to the displacement changing actuator.

6. A pump control arrangement for controlling the displacement of a variable displacement pump that receives fluid from a reservoir, the variable displacement pump having a pressure outlet port and a displacement changing actuator operative to change the displacement of the variable displacement pump between a minimum and a maximum position, the pump control arrangement being adapted for use in a fan drive system having a fluid motor fluidity connected to the variable displacement pump, the pump control arrangement comprising:

a load margin valve arrangement disposed between the pressure outlet port of the variable displacement pump and the displacement changing actuator, the load margin valve arrangement having first and second ends each defining pressure responsive chambers with the first end being spring biased to a position to pass fluid from the variable displacement pump therethrough and the second end thereof being connected to the pressure outlet port of the variable displacement pump; and a proportional solenoid valve arrangement connected to the pressure outlet port of the variable displacement pump and operative to control the flow of pressurized fluid to and from the displacement changing actuator, the proportional solenoid valve arrangement includes a spring biasing mechanism, a proportional valve, and a proportional solenoid, the proportional valve having first and second ends with the spring biasing mechanism disposed at the first end and a pressure chamber defined at the second end and being connected downstream of the proportional valve, the spring biasing mechanism being operative to bias the proportional valve to a position to pass fluid from the variable displacement pump therethrough, and the proportional solenoid is disposed at the second end of the proportional valve and operative to provide a variable force in opposition to the spring bias acting at the first end, the proportional valve is a three-way valve having a first port connected to the reservoir, a second port connected to the pressure outlet port of the variable displacement pump, and a third port connected to the pressure chamber at the first end of the load margin valve arrangement, the proportional valve being movable between first and second positions and at the first position thereof the pressure chamber at the first end of the load margin valve arrangement is in communication with the pressure outlet port of the variable displacement pump and blocked from the reservoir and at the second position thereof the pressure chamber at the first end is in communication with the reservoir and blocked from the pressure outlet port of the variable displacement pump.

7. The pump control arrangement of claim 6 including a filter mechanism and an orifice disposed between the third port of the proportional valve and the first end of the load margin valve arrangement.

8. The pump control arrangement of claim 6 including a control orifice disposed between both the pressure outlet port of the variable displacement pump and the second port of the load margin valve arrangement and the second end of the load margin valve.

9. The pump control arrangement of claim 6 including a pressure cutoff valve disposed between the third port of the load margin valve arrangement and the displacement changing actuator.

10. The pump control arrangement of claim 9 wherein the pressure cutoff valve has first and second ends with the first end being spring biased to a position to communicate the displacement changing actuator with the third port of the load margin valve and blocked from the variable displacement pump and the second end having a pressure responsive chamber connected to the pressure outlet port of the variable displacement pump.

11. The pump control arrangement of claim 10 wherein the pressure cutoff valve is a three-way valve having a first port connected to the third port of the load margin valve arrangement, a second port connected to the pressure outlet port of the variable displacement pump and a third port connected to the displacement changing actuator.

12. The pump control arrangement of claim 11 wherein the displacement of the variable displacement pump is spring biased towards a maximum displacement position and movable towards a minimum displacement position in response to pressurized fluid being delivered to the displacement changing actuator from the pressure cutoff valve.

13. A pump control arrangement for controlling the displacement of a variable displacement pump having a pressure outlet port and a displacement changing actuator operative to change the displacement of the variable displacement pump between a minimum and a maximum position, the pump control arrangement being adapted for use in a fan drive system having a fluid motor fluidity connected to the variable displacement pump, the pump control arrangement comprising:

a load margin valve arrangement having first and second ends each defining pressure responsive chambers with the first end being spring biased to a flow passing position, the load margin valve arrangement being disposed between the pressure outlet port of the variable displacement pump and the displacement changing actuator and the second end thereof being connected to the pressure outlet port of the variable displacement pump;

a pressure cutoff valve having first and second ends with the first end being spring biased to a flow passing position and the second end being connected to the pressure outlet port of the variable displacement pump, the pressure cutoff valve being disposed between the load margin valve arrangement and the displacement changing actuator of the variable displacement pump; and a proportional solenoid valve arrangement being disposed between the pressure outlet port of the variable displacement pump and the first end of the load margin valve arrangement, the proportional solenoid valve arrangement includes a spring biasing mechanism, a proportional valve, and a proportional solenoid, the proportional valve having first and second ends with the spring biasing mechanism disposed at the first end and a pressure chamber defined at the second end, the second end being connected between the proportional valve and the first end of the load margin valve arrangement, the spring biasing mechanism being operative to bias the proportional valve to a flow passing position, and the proportional solenoid is disposed at the second end of the proportional valve and operative to provide a variable force in opposition to the spring bias at the first end.

* * * * *